United States Patent [19]

Secord et al.

[11] 4,173,936

[45] Nov. 13, 1979

[54] TANKS FOR THE STORAGE AND TRANSPORT OF FLUID MEDIA UNDER PRESSURE

[75] Inventors: Herbert C. Secord, Markyate, England; Alfred H. Schwendtner, New York, N.Y.

[73] Assignee: Martacto Naviera S.A., Washington, D.C.

[21] Appl. No.: 829,915

[22] Filed: Sep. 1, 1977

[30] Foreign Application Priority Data

Sep. 8, 1976 [GB] United Kingdom ..... 37247/76

[51] Int. Cl.[2] ..... B63B 25/08

[52] U.S. Cl. ..... 114/74 A; 220/431; 220/438

[58] Field of Search ..... 114/74 R, 74 T, 74 A; 220/9 LG, 9 R, 15, 18, 431, 438

[56] References Cited

U.S. PATENT DOCUMENTS

| | | | |
|---|---|---|---|
| 3,314,567 | 4/1967 | Becker et al. | 220/15 |
| 3,459,148 | 8/1969 | Progler et al. | 114/74 A |
| 4,013,030 | 3/1977 | Stafford | 114/74 A |

FOREIGN PATENT DOCUMENTS

| | | | |
|---|---|---|---|
| 2124037 | 9/1972 | France | 114/74 A |
| 57458 | 1/1937 | Norway | 114/74 R |

*Primary Examiner*—Trygve M. Blix
*Assistant Examiner*—Jesus D. Sotelo
*Attorney, Agent, or Firm*—Rose & Edell

[57] ABSTRACT

A support system is provided for a tank for the storage of fluid media under pressure which tank has its top, bottom and side walls each made up of a series of parallel outwardly convex lobes. The bottom supports of the support system comprise A-frame cradles that are secured to external structure, and have traylike saddles at their apices in which rest blocks of load-bearing heat-insulating material shaped at their tops to fit into interlobe nodal recesses of the tank bottom. When each heat-insulating block is in correct positional relationship with the respective tank bottom recess, the tray in which it rests is filled with synthetic plastics material which sets to anchor the block in place. The support system also comprises top and bottom locating keys which likewise are located at interlobe nodes of the tank top and bottom walls, each consisting of an extension piece or tongue projecting from an interlobe node to engage external support structure. There may be top locating keys at every interlobe node of the tank top but only one central key at the tank bottom.

9 Claims, 6 Drawing Figures

TANKS FOR THE STORAGE AND TRANSPORT OF FLUID MEDIA UNDER PRESSURE

This invention relates to tanks for the transport and storage of fluid media under pressure. More particularly, it is concerned with tanks in ships or barges for the transport by sea in bulk of liquefied gas at low temperature and atmospheric or superatmospheric pressure, including the support and insulation system for the tanks in the ship's hold.

In U.S. Pat. Application Ser. No. 623,110, filed Oct. 16, 1975, there are described tanks of lobed design suitable for this duty, together with means of supporting those tanks. The present invention seeks to improve the scheme of that prior application in certain respects, especially in regard to the support and insulation of the tanks.

According to this invention, the supports for the lobed tanks comprise cradles or A-frames that are welded or otherwise secured to the ship and on which rest blocks of load-bearing heat-insulating material that are shaped at their tops to fit into the interlobe nodal recesses of the tank bottoms; the heat insulation material for the tanks may be applied to the tanks themselves rather than to the ship, or it may take the form of an infill, between the tanks and the ship, of granular or particulate material such as "Perlite".

In the preferred embodiment, such supports are provided at every interlobe node of the tank bottom, the lobes and supports running transversely of the ship, and also keys are provided at every interlobe node of the top of the tank between the tank and the ship's deck structure. The tank bottom may be similarly keyed but there need be only one or a small number of bottom keys. Each key may comprise a vertical extension piece welded to the tank and carrying a block or blocks of load-bearing heat insulating material fitting into a gap between bracket plates on the ship's structure.

Figure 1:
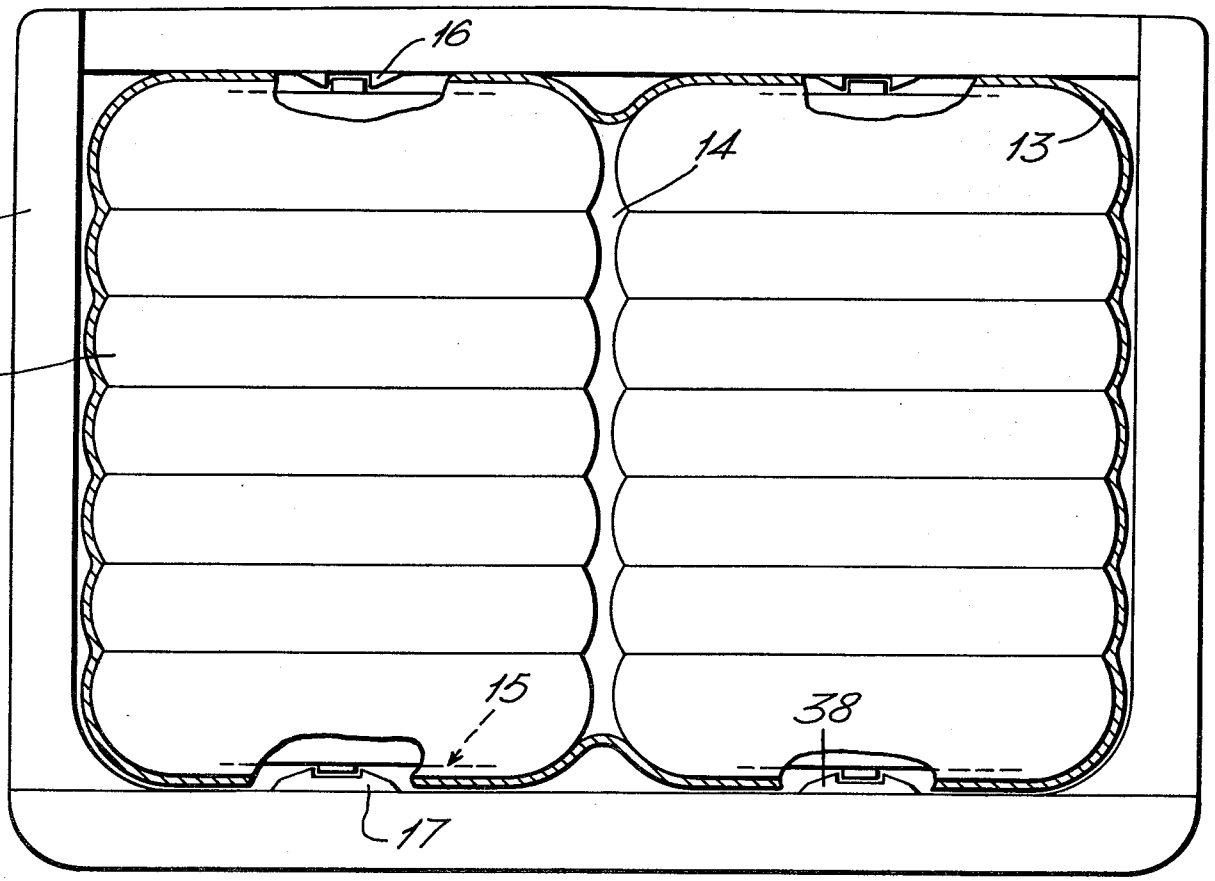
Figure 2:
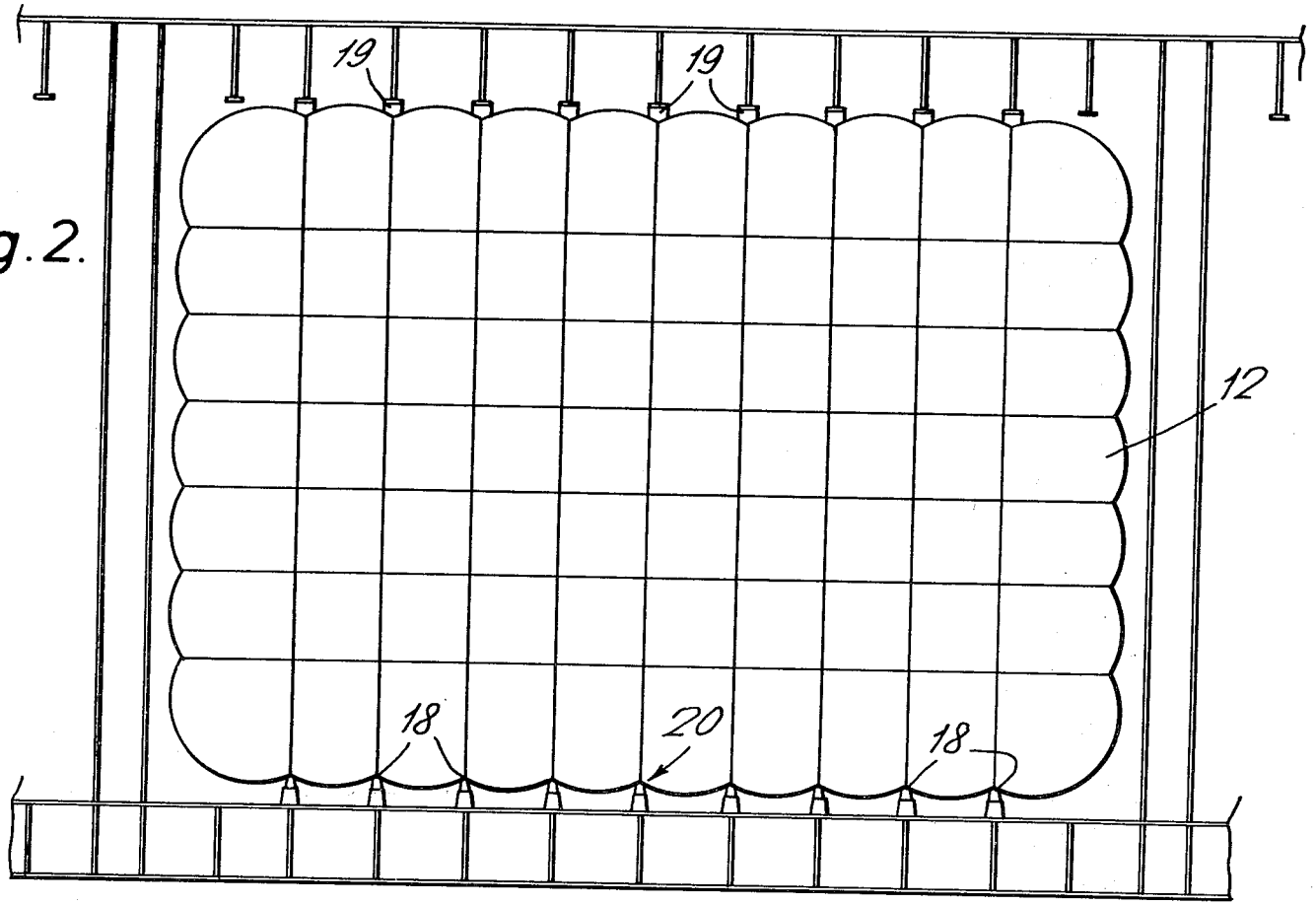
Figure 3:
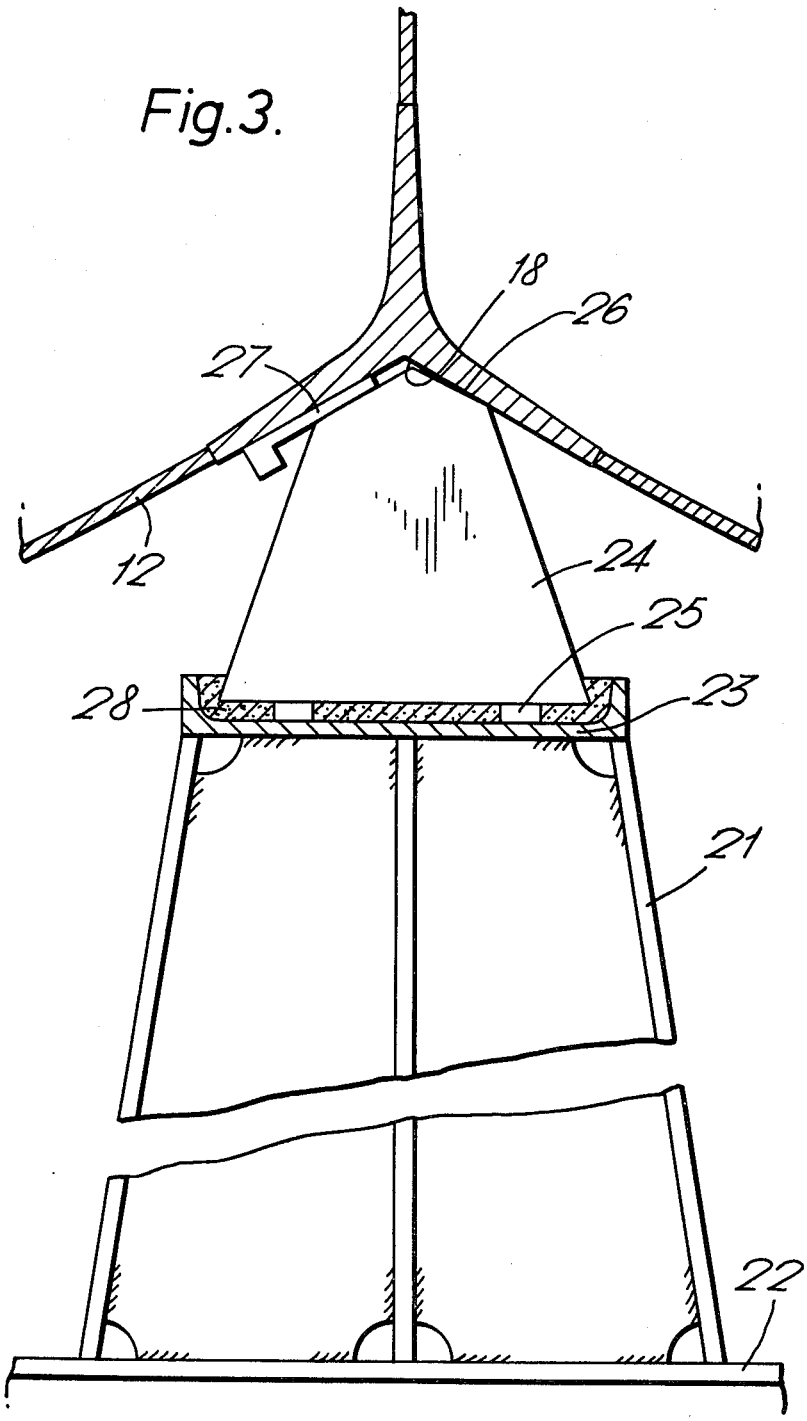
Figure 4:
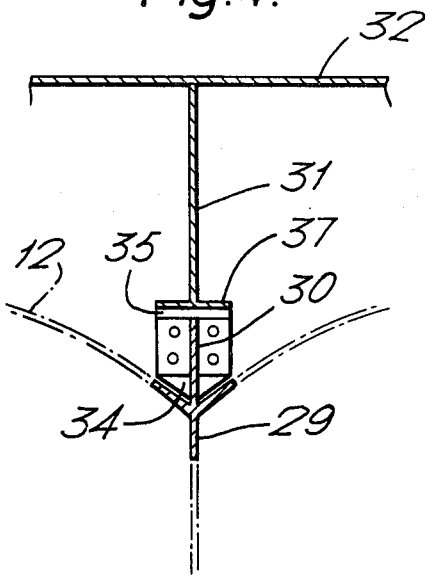
Figure 5:
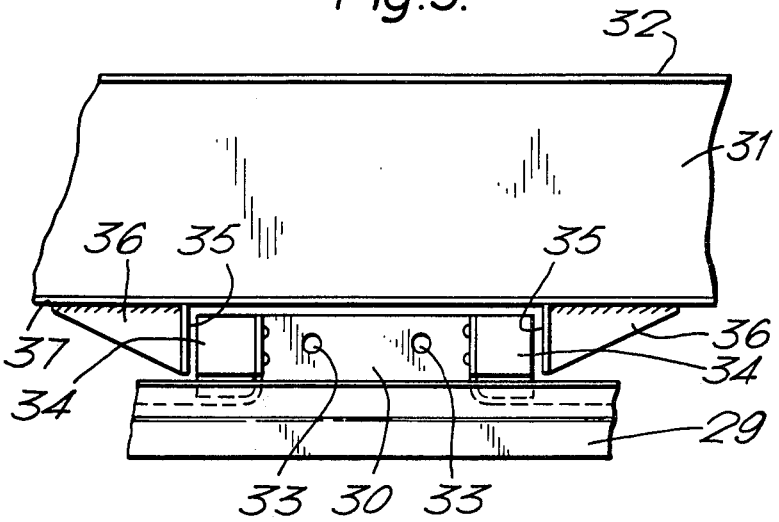
Figure 6:
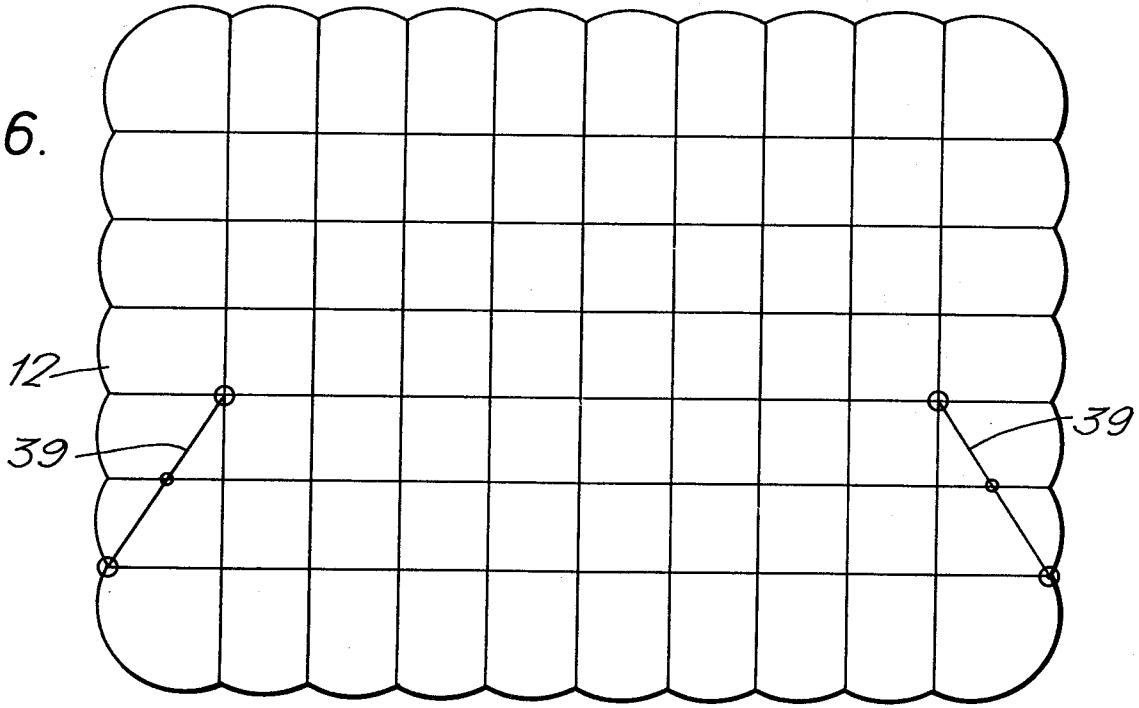

Arrangements according to the invention will now be described by way of example with reference to the accompanying drawings, in which:

FIG. 1 is a cross-section through a ship's hull showing two lobed tanks side by side, FIG. 2 is a longitudinal view of one tank, FIG. 3 is a detail view, in longitudinal elevation, of a tank bottom support, FIGS. 4 and 5 are detail views, in longitudinal and transverse elevation, of a tank top key, and FIG. 6 is a diagrammatic view of a tank in longitudinal section showing a modification to the internal bracing.

FIG. 1 shows a ship's hull 11 containing two lobed tanks 12 side by side. Insulation 13 is applied to the external wall surfaces of the tanks and bridges the gap 14 between the two tanks, as shown, both at the top and bottom of the tanks and at the tank ends. Each tank has both bottom supports 15 and top and bottom locating keys 16, 17, as can be seen in FIG. 2. The bottom supports 15 are located at every interlobe node 18 of the tank bottom, nine locations in all in the example shown, and likewise the top keys 16 are located at every interlobe node 19 of the top of the tank, again nine locations, but only one bottom key is provided at 20 midway along the tank.

FIG. 3 shows the detail of a tank bottom support 15. A mild steel pedestal structure or A-frame 21 is welded to the ship's tank top 22 and has a flat traylike saddle 23 at the top on which rests an upwardly-tapering block 24 of resin-impregnated wood laminate such as is supplied under the Trade Mark PERMALI. This material has the property of being both load-bearing and heat-insulating. Initially, the block 24 rests on locating pieces or chocks 25 and is positioned with its peaked top 26 located in the respective interlobe node of the tank bottom, a temporary locating wedge 27 being used, if necessary. As shown in the drawing, the vertical axis of the block 24 is slightly offset horizontally from the nodal point of the tank bottom recess. The position of each block is calculated so that as the tank cools on being filled with cargo the contraction of the tank and consequent horizontal shifting of the interlobe nodes brings the nodal points of the tank bottom recesses in which the support blocks 24 are located all precisely into alignment with those blocks. No wedges 27 are then required. The space under the block 24 around the chocks 25 is filled with a liquid resin 28 which is poured in to fill the saddle tray 23 and sets in situ, thereby permanently fixing the position of the block both vertically and horizontally. These supports extend continuously across the tank except for the support midway along the tank which is interrupted at its centre to accommodate the tank bottom key 17.

FIGS. 4 and 5 show the arrangement of the tank top keys 16. Each interlobe node at the top of the tank is formed by welding in an insert member 29 of Y-cross section, as described in the aforesaid prior patent application, and at the location of the key the Y insert member 29 has an extension piece 30 that projects vertically upward from the node in alignment with the web of an under-deck girder 31 of the ships deck 32. The extension piece 30 may have holes 33, for use in lifting the tank, and end face plates which are also vertical but at right angles to the main portion of the extension piece. 'PERMALI' blocks 34 are bolted to the end face plates of the extension piece 30, and next to these blocks are face plates 35 on brackets 36 welded to the underside of the under-deck girder flange 37, the keying action being provided by engagement of the blocks 34 with the face plates 35.

The key 17 at the middle of the tank bottom is constructed in a similar way to that shown in FIGS. 4 and 5 but inverted. In that case, the fixed abutments or face plates of the key that are carried by the ship's structure can be provided at opposite sides of a channel formed in a single large bracket as for the top keys.

In the aforesaid prior patent application, support saddles are proposed beneath the overhung lobes at the side edges of each tank. If these are omitted the tank may require additional internal end braces 39 at the positions shown in FIG. 6, which is a view of a tank in longitudinal section.

Since the PERMALI blocks 24 constitute a thermal barrier between the tank and the bottom supports 21 the latter can be of non-cryogenic steel. Also, the technique of setting the blocks in place by means of chocks and wedges and then pouring in liquid resin makes it a simple matter to match the tank and the supports. The tank is stably supported while at the same time it is able to contract and expand thermally without these movements being directly translated into the supports. Very accurate alignment of the tanks in the ship is unnecessary. The bottom supports can be made as stiff as is needed to secure the tank.

Modifications of the particular arrangement described are, of course, possible without departing from the scope of the invention. Thus, although only one bottom key has been shown, more than one can be provided if necessary. It is also possible to adapt the top keys so that the tank could hang from, and be therefore in part supported by, them when it is in the empty unpressurised condition.

The tank may be further provided with anti-floatation and/or anti-collision chocks, these being chocks attached to the ship's structure, rather like the bottom supports, but designed to hold the tank against movement in the event of a collision or against floating if the hold should become partially flooded with water.

What we claim is:

1. A support system for a tank of which at least the bottom wall is made up of a series of outwardly convex lobes that are elongated in one horizontal direction so as to form a series of parallel interlobe nodal recesses between the lobes, said support system comprising a plurality of support assemblies under the tank, each support assembly consisting of a pedestal upstanding from external support structure below the tank, and a block of load-bearing heat-insulating material supported on said pedestal and tapering upwardly to an apex at its top which is shaped to fit contiguously into an interlobe nodal recess of the tank bottom, said pedestal having at its bottom a base secured to said external support structure and further having at its top a tray-like saddle with a horizontal floor in which the bottom of said block rests, with synthetic plastics material filling said saddle tray and in which said bottom of said block is embedded, the width of said bottom of said block, in the horizontal direction at right angles to the longitudinal direction of said parallel lobes forming the bottom of the tank, being less than the width in the same direction of said tray-like saddle so as to allow for a degree of misalignment between said pedestal and the interlobe recess of the tank bottom.

2. A support system according to claim 1, wherein a bottom support assembly is located at every interlobe nodal recess of the tank bottom.

3. A support system according to claim 1, wherein the tank is further provided with top and bottom locating keys.

4. A support system according to claim 3, wherein the tank top wall also is made up of a series of parallel outwardly convex lobes, and the top locating keys are located at every interlobe node of the top of the tank.

5. A support system according to claim 3, wherein only one bottom locating key is provided midway along the tank.

6. A support system according to claim 1, wherein the heat-insulating block of each support assembly is so positioned as to locate accurately in the respective interlobe nodal recess of the tank bottom when the tank is at cargo temperature, the synthetic plastics material being solidified around the bottom of the block when the correct position of the block has been obtained.

7. A support system according to claim 1, wherein at least some of the bottom support assemblies extend continuously across the tank bottom.

8. A support system according to claim 3, wherein each locating key comprises an extension piece or tongue projecting from an interlobe node of the tank vertically toward external support structure, and a pair of blocks of heat-insulating material fixed to said external support structure and located at opposite ends of said extension piece, the extension piece having end plates to engage the blocks and provide the keying function.

9. A support system for a tank within the hull of a ship, and according to claim 1, wherein the parallel lobes of the tank and the bottom support pedestals extend transversely of the ship.

* * * * *